US005186355A

United States Patent [19]

VonDelinde et al.

[11] Patent Number: 5,186,355

[45] Date of Patent: Feb. 16, 1993

[54] COIL POSITION ADJUSTMENT DEVICE FOR VENDING MACHINES

[75] Inventors: Dennis J. VonDelinde, Wright; Gordon M. Jacobs, McGregor, both of Minn.

[73] Assignee: Venex Incorporated, McGregor, Minn.

[21] Appl. No.: 811,947

[22] Filed: Dec. 23, 1991

[51] Int. Cl.[5] ..... G07F 11/36

[52] U.S. Cl. ..... 221/75; 221/258; 221/277

[58] Field of Search ..... 221/75, 123, 124, 125, 221/195, 258, 277, 289; 198/677

[56] References Cited

U.S. PATENT DOCUMENTS 3,294,281 12/1966 Schlaf ..... 221/75 X
4,436,194 3/1984 Hanley ..... 221/75 X
4,958,720 9/1990 Lapeyre et al. ..... 198/677 X
5,024,350 6/1991 Shoemaker, Jr. ..... 221/75

*Primary Examiner*—Robert P. Olszewski
*Assistant Examiner*—Dean A. Reichard
*Attorney, Agent, or Firm*—Haugen and Nikolai

[57] ABSTRACT

Described is an improved apparatus for joining the helical vending coil of a vending machine to its drive mechanism and which allows easy adjustment of the angular position of that coil. Rather than using conventional screws, washers and spacers to join a coil-engaging bracket to its gear-driven drive shaft, in accordance with the invention, a tension spring or other tensioning device operatively deployed between the vending coil coupling bracket and the drive shaft normally urges the bracket into engagement with the drive shaft but will permit the two to be pulled free of one another to allow rotational adjustment without requiring disassembly of many parts or any special tools.

6 Claims, 2 Drawing Sheets

COIL POSITION ADJUSTMENT DEVICE FOR VENDING MACHINES

BACKGROUND OF THE INVENTION

I. Field of the Invention

This invention relates generally to vending machines, and more particularly to an improved apparatus for coupling product vending coils to their associated drive mechanisms to simplify the proper initial positioning of the product delivery coils following a change in the type of product being dispensed.

Discussion of the Prior Art

Vending machines are widely used in the sale of products. A typical vending machine generally includes one or more drawers which are divided into parallel trays having either an open forward or rearward facing end and a closed opposite end, the words "forward" and "rearward" being relative to the front of the vending machine itself. Located in each of the trays is a rigid open helix or coil which is adapted to be driven by a motor drive assembly or manually rotated when coinage or credit totalling the vend price for a selected item has been deposited. The products to be dispensed are loaded by a service person between adjacent convolutions of the rigid helix, and the motor or manual drive is designed to rotate that helix a predetermined number of degrees sufficient to advance the product beyond the front or rear open edge of the tray so that it will drop into a receptacle where it can be retrieved by the purchaser.

In the past, it has been the practice to mount the coil drive mechanism on the closed end surface of the tray and with a drive shaft passing through an opening in that closed end. The drive shaft itself typically has a non-circular cross-section, e.g., square, and a U-shaped mounting bracket, joined to the end convolution of the dispensing coil, has a correspondingly shaped opening in its web, allowing it to receive the drive shaft. A screw, washer and a spacer is then used to secure the bracket to the drive shaft, the screw passing through the washer, bracket and spacer into a threaded bore formed longitudinally in the end of the drive shaft.

While the above-described approach has been effective to couple the coil to its associated drive assembly, it unduly delays the service person when the time comes to refill a particular coil assembly with a product different from that which had been dispensed immediately before. To better understand the problem, it must be understood that the coil has to be properly positioned so that, given the amount of rotation imparted to it each time that the coil drive assembly is actuated, it must advance the product sufficiently to allow it to drop off the forward end of the shelf in which the coil is disposed. Different size products require different initial angular settings of the dispensing coil. With the prior art method of joining the vend coil to its drive shaft, it has been necessary for the service person to slide out the shelf assembly, remove the retaining clips, pull the coil free of its mounting bracket to gain access to the holding screw, use a screw driver or similar tool to remove the screw, the washer and the spacer, remove the mounting bracket from the end of the drive shaft, rotate the mounting bracket to its new angular position relative to the drive shaft and reverse all of the above steps to reassemble the coil to the drive shaft. It is has been found from experience that it can take up to 20 minutes by an experienced service person to properly reset a single coil upon a product change.

A need therefore exists in the art for a mechanism which will allow the vending coil in a vending machine to be more readily repositioned when it is desired to change the product to be vended via that coil. It is the principal object of the present invention to provide such a means, and one which will not be overly costly.

It is another object of the invention to provide a low-cost coupling device for joining a dispensing coil or helix of a vending machine to its drive shaft (either manual or electrically driven) and which allows the angular position of the coil to be adjusted in only a matter of seconds and without requiring any special tools or disassembly.

SUMMARY OF THE INVENTION

The present invention is directed to an improved apparatus for coupling a motor-driven or manually-driven drive shaft to a product dispensing coil of a vending machine whereby the initial adjustment of the angular position of the coil can be more readily set when new products are being loaded into the coil by a service person. The vending machine itself is of the well-known type in which a plurality of products to be sold are contained between the convolutions of a corresponding plurality of product dispensing coils disposed in parallel trays in a drawer-like assembly contained within the vending machine cabinet. Each of the trays has a floor upon which the coil rests, a perpendicularly extending end wall and an open opposite face. Mounted on the rear wall are a plurality of drive devices (one for each coil), each having a drive shaft of non-circular cross-section, typically a polygon. Coupled to the end-most convolution of each of the plural coils is a bracket having a non-circular opening through which a mating drive shaft may pass.

Rather than bolting the bracket to its associated drive shaft as in the prior art, in accordance with the present invention, a tension spring or other means of resiliently tensioning is used to yieldably couple the coil bracket to its mating shaft, allowing the coil position to be easily adjusted by simply gripping the conveniently accessible forward end of the coil, pulling it against the force of the tensioning device until the bracket slides free of its drive shaft, rotating the coil to a desired angular position and then releasing the pulling force and allowing the tensioner to return the bracket to its new angular position in which it engages the drive shaft.

In carrying out the invention, it has been found expedient to provide a longitudinal bore through the drive shaft with a rigid wire pin and the tensioner concentrically mounted on the pin extending through that bore, one end of the spring being secured to the end of the pin and the other end of the spring being coupled to a portion of the coil which fits into the bracket.

DESCRIPTION OF THE DRAWINGS

The foregoing features, objects and advantages of the invention will become more apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
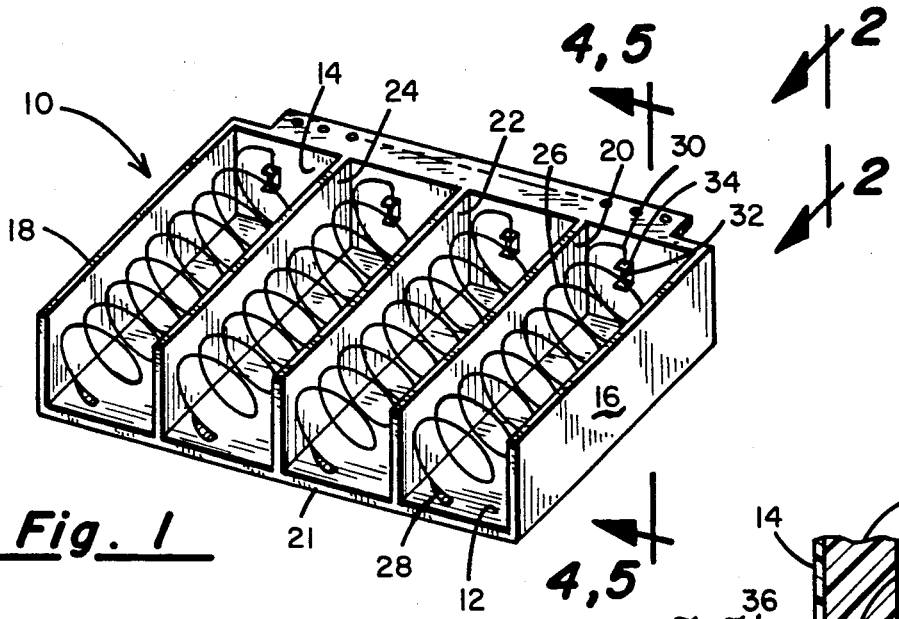
FIG. 1 is a perspective view of a drawer assembly of a typical vending machine showing a plurality of vending coils disposed in tray-like compartments.

FIG. 1 illustrates a typical drawer assembly found in a coin-operated vending machine for dispensing snack foods or other products. Typically several drawers like those shown in FIG. 1 would be vertically stacked within the cabinet of the vending machine. The drawer assembly is indicated generally by numeral 10 and is seen to include a bottom or floor member 12, a rear wall 14 extending at right angles to the floor 12 and mutually perpendicular side walls 16 and 18. The drawer is divided into contiguous parallel trays by dividers 20, 22 and 24 which run parallel to the side walls 16 and 18. As is illustrated in FIG. 1, each of the trays has an open front face and located in each is a product dispensing coil as at 26. The coils are generally rigid helixes having open or spaced apart convolutions and the products to be dispensed (not shown) are inserted between the adjacent convolutions. Affixed to the front end of the coils is an optional plastic kicker member 28, which serves to urge the lead product in the coil off the front edge 21 of the drawer 10. As will be explained in greater detail hereinbelow, the rearmost end of the coil 26 is bent radially inward as at 30 to create a straight shank portion 32 which is made to pass through two aligned apertures formed in the legs of a U-shaped bracket 34.

Figure 3:
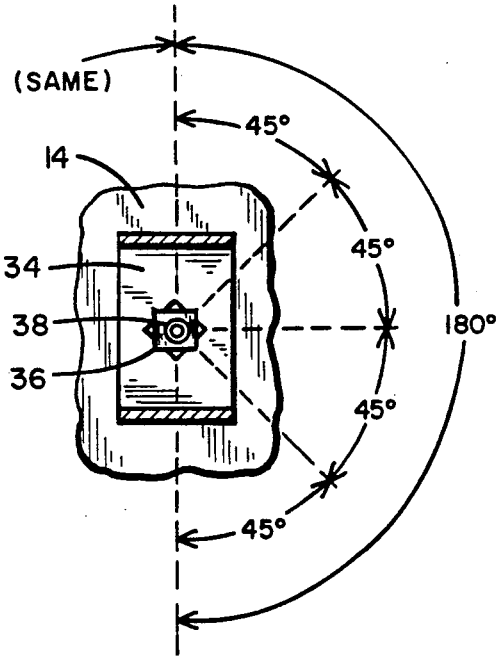
FIG. 3 is a cross-sectional view taken along the lines 3—3 in FIG. 5*a;*

As can best be seen in FIG. 3, formed midway between the parallel legs of the bracket 34 is a non-circular opening 36, here shown as a star created by off-setting two square openings by 45°. This aperture is dimensioned to receive the non-circular (square) portion 38 of the output shaft 48 of a drive assembly 40. While an 8-pointed star-shaped opening in the bracket is shown for receiving a square shaft, those skilled in the art will realize that other non-circular openings and shaft shape configurations can be employed.

Figure 2:
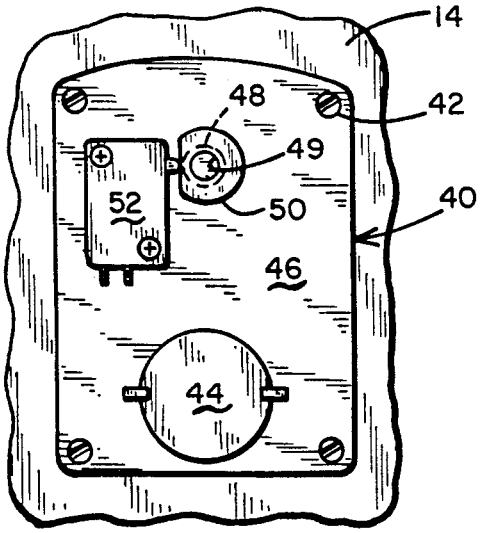
FIG. 2 is a partial rear view of the drawer assembly of FIG. 1 showing the coil drive assembly mounted on the rear face of the drawer.

A rear view of the drive assembly is shown in FIG. 2. Here, the drive assembly is illustrated as having an electric motor, but the invention will also be useable with a manually rotatable drive mechanism so that limitation to a motorized mechanism should not be inferred. One such drive assembly is provided for each of the coils and is mounted on the rear face of the rear wall 14 by suitable fasteners, such as screws 42. It includes a motor 44 whose armature shaft is coupled via gears (not shown) located in the gear box 46 to drive the output drive shaft 48. When viewed from the rear as shown in FIG. 2, the output drive shaft 48 is seen to include a longitudinal bore 49 and extending through it a cam surface 50 formed thereon for cooperating with a "MICROSWITCH"type electrical switch 52 or other device for providing a signal indicative of shaft rotation. The other end of the shaft 48 passes through a clearance hole in the rear wall 14 of the drawer 10 and extends outward from the inner surface of that wall. It is this extension 38 that has the square shape and which is designed to pass through a correspondingly shaped aperture in the base of the U-shaped bracket 34 as in FIG. 3. The shape of the cam 50 determines the extent of rotation of the shaft each time the motor 44 is energized by signals coming from the vending machine control board which occur when a proper vend price has been satisfied by the deposit of coinage or credit and a product selection has been made.

Figure 4A:
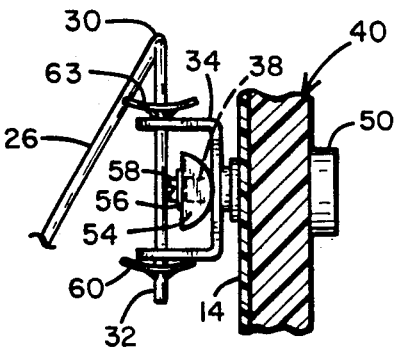
PRIOR ART Fig. 4a
FIGS. 4*a,* 4*b* and 4*c* are views illustrating the sequence of steps needed to adjust the vend coil's angular position in accordance with the prior art system for coupling the vend coil to its associated drive assembly.
Figure 4B:
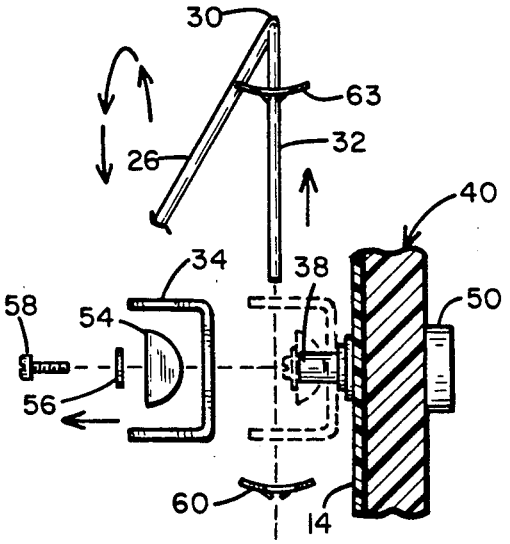
PRIOR ART Fig. 4b
Figure 4C:
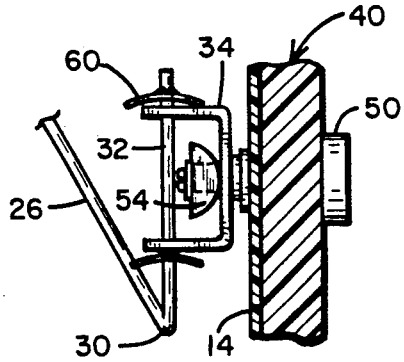
PRIOR ART Fig. 4c

In accordance with the prior art, and as reflected in FIG. 4*a* through 4*c,* the U-shaped bracket 34 fits over the square end portion 38 of the output shaft 48 and the assembly is held in place by means of a arcuate spacer 54, a washer 56 and a screw 58. These parts can better be seen in the exploded view of FIG. 4*b.*

As earlier mentioned, the radially extending end shank 32 of the coil 26 is arranged to pass through two aligned apertures formed through the legs of the bracket 34 and conventional spring clips 60 and 63 are fitted onto the shank to maintain the coil axially centered relative to the drive shaft 48.

It can be readily appreciated from what has thus far been described that when the motor 44 is energized to drive the shaft 48, because of the engagement between the non-circular aperture formed in the base of the bracket 34 and the square end 38 of the drive shaft, the bracket 34 will rotate with the shaft and will carry the coil 26 with it. The amount of rotation is determined by the cam profile and its cooperation with the switch 52. It must be sufficient to rotate the coil to the extent that the kicker 28 will deliver the frontmost product off the open edge 21 of the bottom of the tray 12.

Because different products may dictate different initial settings of the angular position of the kicker, it frequently becomes necessary for a service person to adjust the angular position of the coil at the time that the vending machine product being dispensed from a given coil is changed to accommodate a different product. In accordance with the prior art, to change the initial angular positioning of the coil 26, it first becomes necessary to remove the spring clip 60 from the free end of the shank 32 so that the shank can be pulled free of the bracket 34. See FIG. 4*b.* Then, the service person must use a screw driver to remove the screw 58 along with the washer 56, the spacer 54 and the bracket 34 from the square end portion 38 of the output drive shaft. The service person must then realign the non-circular aperture 36 in the bracket 34 with the shaft, insert the square end of the shaft through the bracket, install the spacer, washer and retaining screw and then, again, insert the shank 32 through the aligned apertures in the legs of the bracket and finally reinstall the clip 60.

The foregoing prior art design makes it rather time consuming to make the coil adjustment each time a new product is to be vended from a particular coil. As mentioned above, a trained service person may take anywhere from 15 to 20 minutes to make the required adjustment. Having explained the prior art approach in detail, it is believed that a better appreciation for the advantages of the present invention can be understood.

Figure 6:
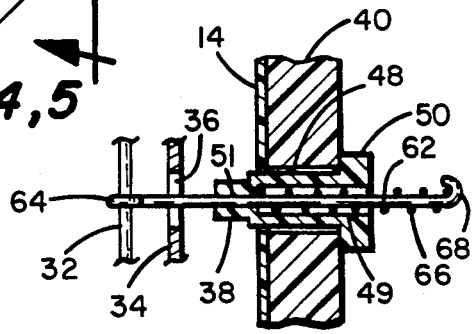
FIG. 6 is a cross-sectional view taken along the line 6—6 in FIG. 5*c.*
Figure 5A:
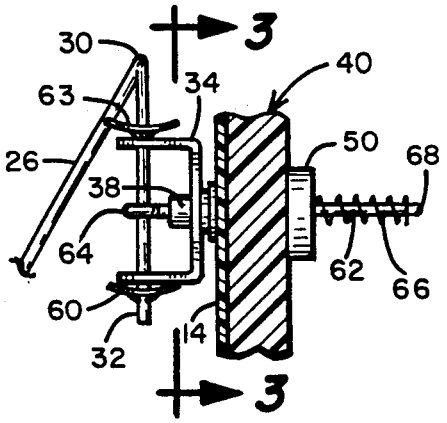
FIGS. 5*a,* 5*b* and 5*c* show the sequence and steps for making the same adjustment using the coupling mechanism of the present invention.

Referring to FIGS. 5*a,* 5*b* and 5*c* and the sectional view of FIG. 6, the present invention will next be explained.

Figure 5B:
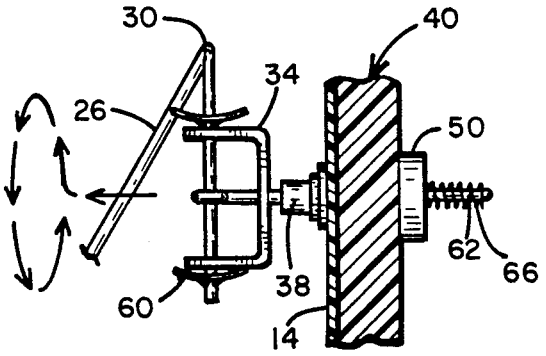
Figure 5C:
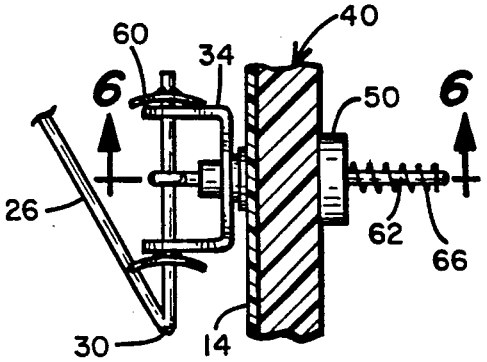

It can be observed from the views of FIGS. 5*a* through 5*c,* that the screw 58, the washer 56 and the spacer 54 used in the prior art arrangement are not required. Instead, a rigid pin 62 having a first end 64 bent into a hook passes through the longitudinal bore 49 and a counterbore 51 formed in the drive shaft 48 with the hook engaging the shank 32 of the coil 26. Surrounding the pin 62 is a tensioner spring 66, which is disposed between a bent hook formed on the opposite end 68 of the pin 62 and the shoulder formed in shaft 48 at the junction between the larger bore 49 and the smaller diameter counterbore 51. Hence, the spring 66 acts to normally bias the pin 62 to the right when viewed as in FIG. 5*a*, thus firmly urging the bracket 34 into full engagement with the square portion 38 of the drive shaft. While a tension spring 66 is preferred, it is also possible to employ an elastomeric band to provide the tensioning force.

Referring to FIG. 5*b*, to adjust the angular position of the kicker bracket 28, the service person need only grasp the coil 28 (FIG. 1), pulling the helical coil towards himself/herself and thereby compressing the spring 66 to the point where the bracket 34 clears its engagement with the shaft portion 38. The operator may now simultaneously rotate the coil until the end of the coil is in a desired angular position, at which point the pulling force is relaxed, allowing the spring 66 to again pull the bracket 34 into its mating engagement with the shaft portion 38 as is shown in FIG. 5*c*.

As is apparent, there is no longer a need to physically disassemble the coil from its bracket nor is it necessary to remove any holding screws and related hardware. Absolutely no tools are required to make the adjustment. When using the approach of the present invention, the initial positioning of the coil upon a product change can be accomplished in 10 seconds or less where the prior art design would require up to 20 minutes.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A method for adjusting the angular orientation of a product delivery coil of a vending machine, said vending machine being of the type in which products to be vended are placed between the convolutions of a generally rigid product delivery coil, said product delivery coil being supported in an elongated tray having an open front face and a generally closed rear face, a drive means operatively coupled to said product delivery coil, said drive means having an output drive shaft of a non-circular cross-section coupled in driving relation to one end of said product delivery coil comprising the steps of:

(a) attaching a bracket to said one end of said product delivery coil where the bracket includes a non-circular aperture therethrough of a shape conforming to said non-circular cross-section of said drive shaft;

(b) coupling a resilient tensioning means between said drive shaft and said bracket whereby said resilient tensioning means yieldably maintains said drive shaft within said non-circular aperture;

(c) applying a tension force to the other end of said product delivery coil sufficient to displace said bracket to the point where its non-circular aperture no longer engages said output drive shaft of non-circular cross-section;

(d) rotating said product delivery coil to a new desired angular position; and (e) allowing said resilient tensioning means to retract said bracket to the point where its non-circular aperture fits about said non-circular cross-section of said output drive shaft.

2. In a vending machine of the type in which products to be vended are placed between the convolutions of a generally rigid helix, said helix being supported in an elongated tray having an open front face and a generally closed rear face, a drive means operatively coupled to said helix, said drive means having an output drive shaft with a longitudinal bore extending therethrough and a non-circular cross-section, said drive shaft coupled in driving relation to one end of said helix, an improved coupling mechanism for joining said output drive shaft to said one end of said helix comprising:

(a) a generally U-shaped bracket with a central web joining parallel, spaced-apart legs, each of said legs including an aperture aligned with that in the other leg for receiving a radially extending shank portion of said one end of said helix therethrough, said bracket having a non-circular aperture through said web portion of a shape conforming to said non-circular cross-section of said drive shaft;

(b) a compression type coil spring having first and second ends, said spring being disposed within said longitudinal bore in said drive shaft; and (c) a rigid pin having first and second ends and coaxially disposed in said coil spring, said first end of said pin being coupled to said radially extending shank portion of said helix and said second end of said pin engaging said first end of said coil spring.

3. The coupling mechanism as in claim 2 wherein said non-circular cross-section is polygonal shaped.

4. The coupling mechanism as in claim 2 wherein a tension force applied to said helix proximate said front face of said tray is resisted by said coil spring.

5. The coupling mechanism as in claim 4 wherein sufficient tension force applied to said helix proximate said open front face of said tray extracts said drive shaft from said aperture in said bracket, allowing said helix to be rotated independent of said output drive shaft.

6. The coupling mechanism as in claim 5 wherein the force exerted by said coil spring draws said bracket about said drive shaft when said non-circular aperture is appropriately aligned with said drive shaft and said tension force is released.

* * * * *